US009725832B1

(12) United States Patent
Ouellette et al.

(10) Patent No.: US 9,725,832 B1
(45) Date of Patent: Aug. 8, 2017

(54) WEAVING MULTILAYER PRODUCTS USING MULTIPLE WARP COLUMNS AND HEDDLE COLUMNS

(71) Applicant: Albany Engineered Composites, Inc., Rochester, NH (US)

(72) Inventors: Kenneth Ouellette, Kennebunk, ME (US); Jonathan Goering, York, ME (US)

(73) Assignee: Albany Engineered Composites, Inc., Rochester, NH (US)

( * ) Notice: Subject to any disclaimer, the term of this patent is extended or adjusted under 35 U.S.C. 154(b) by 23 days.

(21) Appl. No.: 15/019,137

(22) Filed: Feb. 9, 2016

(51) Int. Cl.
*D03C 9/02* (2006.01)
*D03C 9/00* (2006.01)

(52) U.S. Cl.
CPC ..... *D03C 9/02* (2013.01)

(58) Field of Classification Search
CPC ..... D03D 11/00; D03D 25/005; D03D 3/00; D03D 11/02; D03D 13/00; D03D 13/004; D03D 1/00; D03D 41/004; D03D 49/04; D03D 49/12; D03C 3/12; D03C 9/02; D03C 3/20
See application file for complete search history.

(56) References Cited

U.S. PATENT DOCUMENTS 3,695,304 A * 10/1972 Menegatto ..... D03C 5/02 139/57
5,837,622 A * 11/1998 Hamilton ..... D02G 3/328 442/184
9,309,610 B2 * 4/2016 Crawford ..... D03D 3/00
9,539,787 B2 * 1/2017 Godon ..... D03D 3/00
2014/0349538 A1 * 11/2014 Marchal ..... B29C 70/24 442/206
2015/0114511 A1 4/2015 Dambrine et al.
2016/0376734 A1 * 12/2016 Rousseau ..... D03C 3/12 139/11

FOREIGN PATENT DOCUMENTS

DE 10 2012 101 016 A1 8/2013
JP 2007-023449 A 2/2007

OTHER PUBLICATIONS

International Search Report and Written Opinion issued by the EPO, acting at the ISA, for international application PCT/US2017/016191 mailed May 10, 2017.

* cited by examiner

*Primary Examiner* — Bobby Muromoto, Jr.
(74) *Attorney, Agent, or Firm* — McCarter & English, LLP

(57) ABSTRACT

An apparatus for weaving a multilayer product that has one or more warp columns for placing warp fibers and one or more heddle columns for heddles for lacing the warp fibers. The weaving apparatus has a numerical ratio of warp columns and heddle columns that is a fractional number. And a portion of the warp fibers are laceable through heddles on one or more heddle columns based on the fractional number. A method for weaving a multilayer product where adjacent warp fibers are segmented and laced through heddles on the heddle columns based on the fractional number.

20 Claims, 6 Drawing Sheets

WEAVING MULTILAYER PRODUCTS USING MULTIPLE WARP COLUMNS AND HEDDLE COLUMNS

BACKGROUND

1. Field of the Invention

This invention is related to weaving of multilayer products woven from columns of warp fibers controlled by heddle columns. In particular, the ratio of the number of warp columns to the number of heddle columns is a fractional number.

2. Description of the Related Art

The use of reinforced composite materials to produce structural components is now widespread, particularly in applications where their sought desirable characteristics are being light in weight, strong, tough, thermally resistant, self-supporting and adaptable to being formed and shaped. Such components are used, for example, in aeronautical, aerospace, satellite, recreational use (as in racing boats and autos), and other applications.

Typically such components consist of reinforcement materials embedded in matrix materials. The reinforcement component may be made from materials such as glass, carbon, ceramic, aramid, polyethylene, and/or other materials which exhibit desired physical, thermal, chemical and/or other properties, chief among which is great strength against stress failure. Through the use of such reinforcement materials, which ultimately become a constituent element of the completed component, the desired characteristics of the reinforcement materials, such as very high strength, are imparted to the completed composite component. The constituent reinforcement materials may, for example, be woven into multilayer preform structures.

Weaving has been employed for many centuries to create woven structures. Woven structures are formed by interlacing threads, yarns, or fibers that fall into two categories: (i) the "warp threads", yarns, or fibers that are parallel to the selvedges, or edges, (sometimes called machine direction or MD) and which are interlaced or "woven," with (ii) a perpendicular series of "weft threads", yarns, or fibers (sometimes called cross-machine direction or CD). Typically, the warp and weft yarns or fibers are interlaced to make a woven structure on a weaving loom. The simplest weave pattern consists of an alternating pattern where each weft thread, yarn, or fiber passes successively above and below a warp thread or fiber. More complex structures are woven in three dimensions (3D weaving) such that additional yarns bind the warp and weft yarns in multilayer structures.

Customarily, weaving looms employ three primary motions within the weaving process: i) shedding, (ii) picking, and (iii) beating-up. Shedding involves forming a triangular opening between groups of warp fibers for the passage of weft fibers by a shuttle, for example. Picking involves passing the weft fiber through the shed. And beating-up involves using a comb-like reed to pack the weft fibers as close as desired to each other in a repeating weave pattern.

Commonly, in Jacquard weaving, the weaving component that is used to separate warp fibers, and form the shed, or triangular opening or space through which the weft fiber can pass, is called a heddle. Control of the vertical position of the heddles controls the formation of the shed. The shed opening may be formed by lifting one set of warp fibers relative to another set. Alternatively, one set of fibers may be lifted from a neutral position and the remaining fibers lowered from the same neutral position. In some cases, alternating warp fibers are lifted with respect to adjacent fibers. Or a number of consecutive fibers are lifted together, or are not raised, to form a desired pattern with the weft fibers in the woven structure.

Usually, heddles are elongated structures made from metal, wire, twisted wire, polymeric braid, pressed sheet metal, polyester, or string with an appropriately sized eye, or opening, through which a warp fiber is passed through. The top and bottom of the heddles have structures that allow them to be attached, connected, or mounted to a component called the heddle harness or heddle column. By and large, warp fibers extend from a warp beam, or warp creel, on one end of the loom, pass through a heddle, and attach to another beam, or fabric column, at the other end of the loom. After the weft fibers are passed through the shed formed by the warp fibers, a reed is used to beat up, or tighten the weft and warp fibers into the desired pattern and density.

One characteristic of woven structures is the number of warp fibers per inch of woven-material width. In weaving terminology, the number of warp fibers per width-wise inch is known as dents per inch or "dpi." For example, a woven structure with 12 warp fibers per width-wise inch would be referred to as a 12 dpi material.

Normally, the weaving loom has suitable heddle-column geometry that was chosen for the woven structure being produced. By way of exemplary illustration, if the woven structure being produced is to have 12 dpi, the heddle column may have 12 heddles per inch. Because each warp yarn passes through one heddle, the dpi of the woven material determines the number of heddles per inch width, or heddle spacing, on the heddle column.

Typically, woven structures to be used for preforms are multilayer 3D structures. That is, when viewed from a horizontal plane, multiple layers of warp ends can be found. For example, in a 32-layer woven structure, there would be 32 warp ends through the thickness of the material when viewed from a horizontal cut. These warp fibers are usually arranged in columns such that a 32-layer woven structure would have 32 warp fibers per warp column.

When weaving a multilayer structure for a preform, the weaving apparatus geometry may be selected such that the heddle-column spacing can be multiplied by a whole number to achieve the desired warp-column spacing. For example, if a 32-layer preform with 12 warp fibers per width-wise inch, or dpi, were desired, the weaving apparatus could have a heddle column with 32 heddles where the heddle spacing would be 12 heddles per inch. As such, fibers on one warp column would be laced through heddles on one heddle column. Alternatively, a heddle column with 64 heddles where the heddle spacing would be 6 heddles per inch may be used. With 64 heddles per column, fibers on two warp columns would be laced through heddles on a heddle column. In some circumstances of multilayer woven structures with high warp fiber counts, configuring the weaving apparatus where one heddle column would weave one warp column can have too much warp and weft fiber congestion to weave efficiently. When configuring the weaving apparatus where one heddle column would weave two warp columns, the depth of the heddles is large so that a very small shed opening may be formed, resulting in poor warp control and difficulties in weaving.

SUMMARY

This disclosure can provide for a weaving apparatus with a warp column and heddle column configuration that allows for efficient weaving of multilayer products by, for example, reducing warp and weft fiber congestion, increasing better warp control, and having an adequate shed opening for weaving.

The terms "fibers", "threads", and "yarns" are interchangeably used in this disclosure. "Fibers", "threads", and "yarns" can refer to, for example, monofilaments, multifilament yarns, twisted yarns, multifilament tows, textured yarns, braided tows, coated yarns, bicomponent monofilament yarns, as well as yarns made from stretch broken fibers. "Fibers" and "yarns" can also refer to glass, carbon, ceramic, aramid, polyethylene, and/or other materials which exhibit desired physical, thermal, chemical and/or other properties, chief among which is great strength against stress failure.

This disclosure can provide for an apparatus for weaving a multilayer product having one or more warp columns for placement of warp fibers and one or more heddle columns for the placement of heddles for lacing warp fibers. This disclosure can provide for a numerical ratio of warp columns and heddle columns that is a fractional number and where a portion of the warp fibers are laceable through the heddles on one or more of the heddle columns based on that fractional number.

This disclosure can provide for an apparatus for weaving a multilayer product having a numerical ratio of warp columns and heddle columns that is a fractional number where the number of warp columns is a high warp column count of at least 3 and the number of heddle columns is less than the high warp column count. And this disclosure can provide for where the number of warp fibers on each of the warp columns equals the number of layers in the multilayer product such that the number of layers in the multilayer product multiplied by the fractional number and further multiplied by the number of heddle columns is at least equal to the number of layers in the multilayer product multiplied by the high warp column count.

This disclosure can provide for a fractional number between 0.1 and 10.5, and would be understood by one of ordinary skill in the art more commonly as between 1.5-4.5. This disclosure can provide for a multilayer product having two or more layers.

This disclosure can provide a method for weaving a multilayer product with the steps of having a weaving apparatus with one or more warp columns and one or more heddle columns where the numerical ratio of the warp columns to heddle columns is a fractional number. And where there is step of segmenting adjacent warp fibers and lacing the segmented warp fibers through the heddles on the heddle columns based on the fractional number. This disclosure can provide for controlling warp fibers laced through heddles on heddle columns with the heddles.

For a better understanding of this disclosure, its operating advantages and specific objects attained by its uses, reference is made to the accompanying descriptive matter in non-limiting, exemplary embodiments of the invention are illustrated.

Terms "comprising" and "comprises" in this disclosure can mean "including" and "includes" or can have the meaning commonly given to the term "comprising" or "comprises" in U.S. Patent Law. Terms "consisting essentially of" or "consists essentially of" if used in the claims have the meaning ascribed to them in U.S. Patent Law.

BRIEF DESCRIPTION OF THE DRAWINGS

The accompanying drawings, which are included to provide a further understanding of the disclosure, are incorporated in and constitute a part of this specification. The drawings presented illustrate different, nonlimiting embodiments of the invention and together with the description serve to explain the principles of this disclosure. In the drawings.

DETAILED DESCRIPTION

Exemplary embodiments of weaving apparatus with warp columns counts and heddle columns counts are disclosed that facilitate weaving multilayer preforms where the ratio of warp columns to heddle columns is a fractional number and where a portion of the warp fibers are laceable through the heddles on one or more of the heddle columns based on the fractional number, allowing for better and more adequate shed space and efficient weaving than in prior art techniques.

Figure 1:
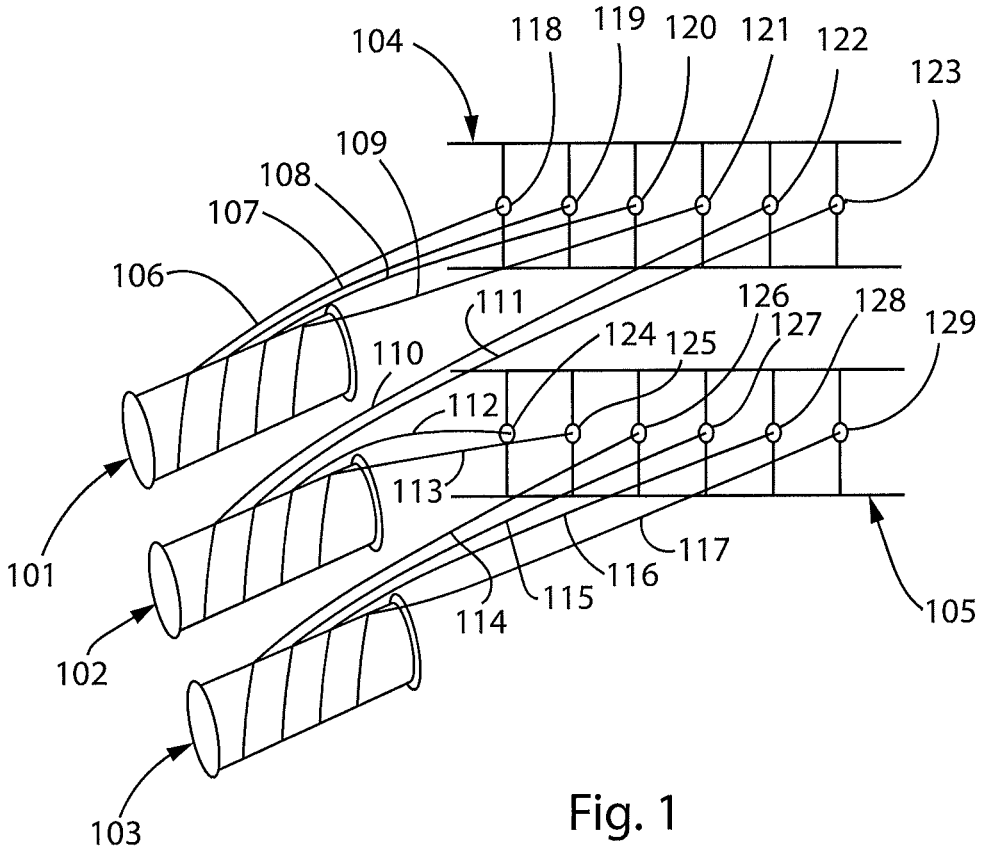
FIG. 1 shows a weaving apparatus with three warp columns and two heddle columns.

Turning to FIG. 1, it shows an exemplary weaving apparatus for weaving a 4-layer multilayer preform with two heddle columns 104, 105 and three warp columns 101, 102, 103. The ratio of warp columns to heddle columns is one and a half as determined by dividing the number of warp columns by the number of heddle columns. FIG. 1 shows warp fibers being laced through heddles on the heddle columns. Warp column 101 shows four exemplary warp fibers 106, 107, 108, 109. Warp column 102 shows four exemplary warp fibers 110, 111, 112, 113. And warp column 103 shows four exemplary warp fibers 114, 115,116, 117. Placement of the warp fibers around the warp columns by wrapping represents a non-limiting manner by which the warp fibers may be placed on each warp column. Additionally, having a four layer multilayer preform and four warp fibers on each warp column is a non-limiting example chosen for clarity in illustration.

FIG. 1 shows lacing the warp fibers through heddles. FIG. 1 shows warp fibers 106-109 extending from warp column 101 and through heddles 118-121 on heddle column 104. Warp fibers 110 and 111 extend from warp column 102 and through heddles 122-123 on heddle column 104. Warp fibers 112-113 extend from warp column 102 and through heddles 124-125 on heddle column 105. Warp fibers 114-117 extend from warp column 103 and through heddles 126-129 on heddle column 105.

FIG. 1 shows a method for lacing warp fibers such that the number of warp fibers on the warp columns laced through heddles on a heddle column reflects the fraction as between the number of warp columns to the number of heddle columns. For example, FIG. 1 represents a fraction of one and a half as between the number of warp columns to the number of heddle columns. FIG. 1 further shows all four warp fibers on warp column 101 and two warp fibers, or half, of the warp fibers on warp column 102 are laced through heddles on heddle column 103. FIG. 1 shows all four warp fibers on warp column 103 and two warp fibers, or half, of the warp fibers on warp column 102 are laced through heddles on heddle column 104. Thus, one and a half of the number of warp fibers are laced through heddles on a heddle column.

Figure 2:
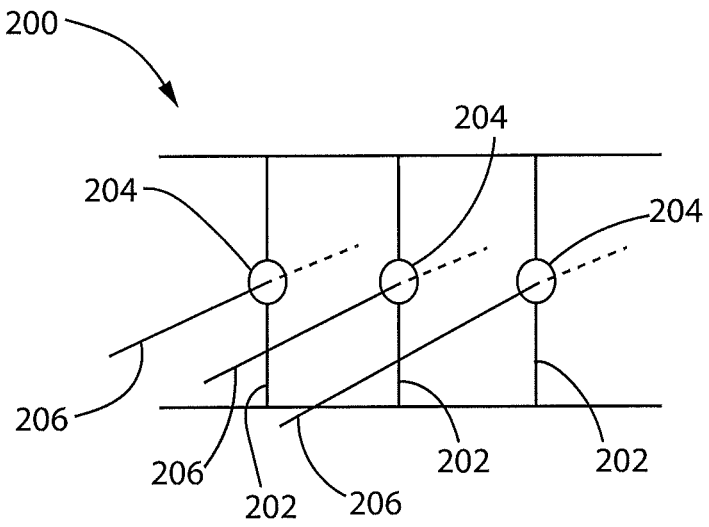
FIG. 2 is a schematic of warp fibers laced through heddles on a heddle column.

FIG. 2 shows heddles 200 attached to heddle columns 202 with a non-limiting example of apertures 204 through which the warp fibers 206 may be laced.

Figure 3:
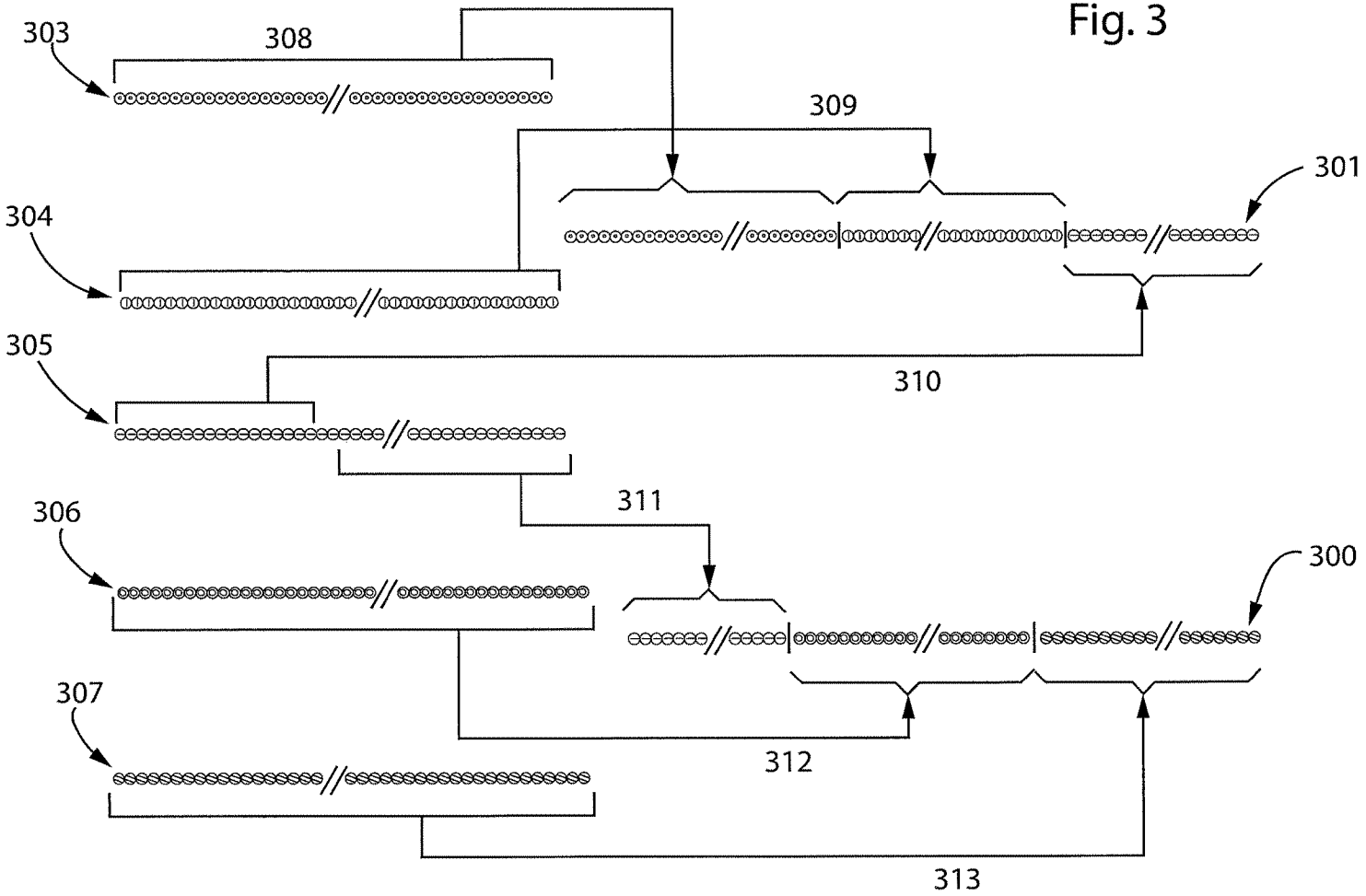
FIG. 3 is a schematic of a top view of two heddle columns and a transverse view of five warp fiber columns with warp fibers.

Turning to FIG. 3, a 60 layer multilayer preform is woven on a weaving apparatus outfitted with two heddle columns 301, 302 and five warp columns 303-307. The ratio of warp columns to heddle columns is two and a half as determined by dividing the number of warp columns by the number of heddle columns. FIG. 3 shows a top view of the two heddle columns 301 and 302. Each heddle column has one hundred and fifty heddles. FIG. 3 shows a transverse view of the five warp columns 303-307. Each warp column has sixty warp fibers. Each warp fiber is laced through a heddle on one of the heddle columns 301, 302.

FIG. 3 shows a method for lacing warp fibers such that the number of warp fibers on the warp columns laced through heddles on a heddle column reflects the fraction as between the number of warp columns to the number of heddle columns. For example, FIG. 3 shows a weaving apparatus where all sixty of the warp fibers on each of warp columns 303, 304 are laced through heddles on heddle column 301. FIG. 3 shows that thirty, or half, of the warp fibers on warp column 305 are laced through heddles on heddle column 301. FIG. 3 shows that the remaining thirty, or half, of the warp fibers on warp column 305 are laced through heddles on heddle column 302. FIG. 3 shows that all sixty of the warp fibers on each of warp columns 306 and 307 are laced through heddles on heddle column 302. Thus, two and a half times the warp fibers on a warp column are laced through heddles on a heddle column.

Moreover, this disclosure can provide a method for lacing adjacent warp fibers on a warp column through adjacent heddles on a heddle column. For example, FIG. 3 shows that adjacent warp fibers on warp column 303 are laced 308 through adjacent heddles in heddle column 301 and adjacent warp fibers on warp column 304 are similarly laced 309 through adjacent heddles in heddle column 301. FIG. 3 shows that adjacent warp fibers on warp column 305 are laced 310 through adjacent heddles in heddle column 301 and that adjacent warp fibers on warp column 305 are laced through adjacent heddles in heddle column 302. FIG. 3 shows that adjacent warp fibers on warp column 306 are laced 312 through adjacent heddles in heddle column 302 and that adjacent warp fibers on warp column 307 are laced 313 through adjacent heddles in heddle column 302.

Further, this disclosure can provide for a number of heddles on each heddle column that can be determined by multiplying the fraction as between the number of warp columns to heddle columns with the number of layers in the multilayer preform. For example, FIG. 3 shows a two and a half fraction and a weaving apparatus for a sixty layer multilayer preform. Multiplying two and a half by sixty equals one hundred and fifty. Thus, FIG. 3 shows one hundred and fifty heddles on each heddle column. This disclosure can provide for a total number of heddles as determined by multiplying the number of heddles on each heddle column with the total number of heddle columns in the weaving apparatus. As an example, FIG. 3 shows one hundred and fifty heddles on each heddle column and two heddle columns, thus equaling three hundred total heddles.

Further, this disclosure can provide for a number of warp fibers on each warp column equal to the number of layers in the multilayer preform. For example, FIG. 3 shows a weaving apparatus for a sixty layer multilayer preform with sixty warp fibers on each warp column. This disclosure can provide for a total number of warp fibers as determined by multiplying the number of warp fibers on each warp column with the total number of warp columns. For example, FIG. 3 shows five warp columns in a weaving apparatus with sixty warp fibers on each warp column that equals three hundred total warp fibers when multiplied.

This disclosure can provide for a total number of heddles that equals or approximately equals the total number of warp fibers. For example, FIG. 3 shows a weaving apparatus for a sixty multilayer preform with one hundred and fifty heddles on each of heddle columns 301, 302—300 total heddles—and three hundred warp fibers on warp columns 303-307.

This disclosure can also provide for a weaving apparatus with a ratio of warp columns to heddle columns that is a fraction and where the number of warp fibers on each warp column equals the number of layers in the multilayer product such that when the number of warp fibers on each warp column is multiplied by that fraction and then further multiplied by the total number of heddle columns, it is at least equal to the number of layers in the multilayer preform multiplied by the number of warp columns. For example, FIG. 3 shows that sixty (warp fibers on each warp column) multiplied by two and a half (fraction) equals one hundred and fifty (heddles on each heddle column) which when further multiplied by two (total heddle columns) equals sixty (multilayer layers) multiplied by five (total warp columns).

Figure 4:
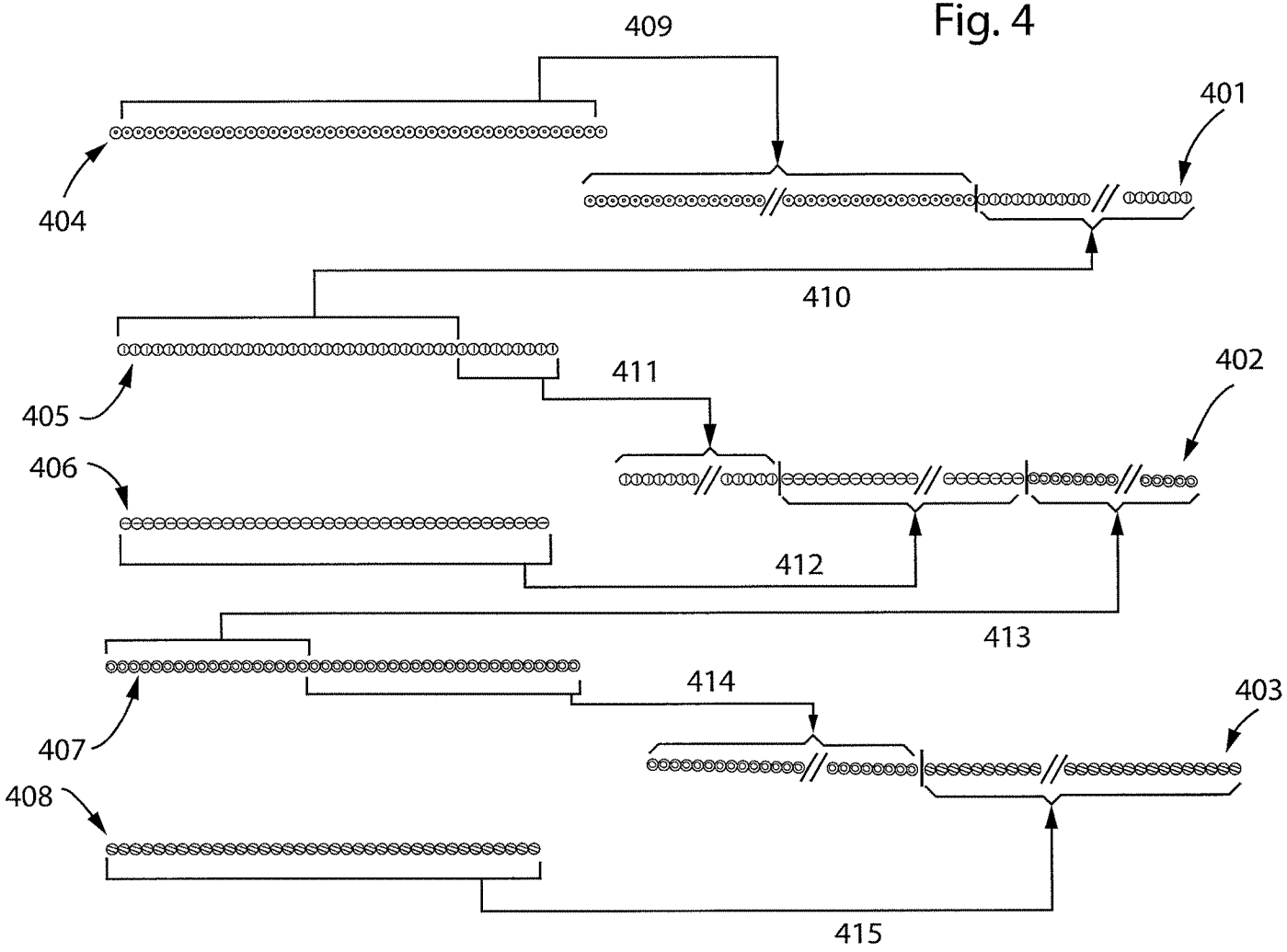
FIG. 4 is a schematic of a top view of three heddle columns and a transverse view of five warp fiber columns with warp fibers.

Turning to FIG. 4, a 40 layer multilayer preform is woven on a weaving apparatus outfitted with three heddle columns 401, 402, 403 and five warp columns 404-408. The ratio of warp columns to heddle columns is one and two thirds as determined by dividing the number of warp columns by the number of heddle columns. FIG. 4 shows a top view of the three heddle columns 401-403. Each heddle column has sixty seven heddles. FIG. 4 shows a transverse view of the five warp columns 404-408. Each warp column has forty warp fibers, equaling the number of layers in the multilayer preform. Each warp fiber is laced through a heddle on one of the heddle columns 401-403.

FIG. 4 shows a method for lacing warp fibers such that the number of warp fibers on the warp columns laced through heddles on a heddle column reflects the fraction as between the number of warp columns to the number of heddle columns. For example, FIG. 4 shows a weaving apparatus where all of the warp fibers on warp column 404 and two thirds of the warp fibers on warp column 405 are laced 409, 410 through heddles on heddle column 401. FIG. 4 shows one third of the warp fibers on warp column 405 and one third of the warp fibers on warp column 407 and all warp fibers on warp column 406 are laced 411, 412, 413 through heddles on heddle column 402. FIG. 4 shows two thirds of warp fibers on warp column 407 and all warp fibers on warp column 408 are laced 414, 415 through heddles on heddle column 403. Thus, one and two thirds of the warp fibers on the warp columns are laced through heddles on a heddle column.

The number of heddles on each heddle column in FIG. 4 can be determined by multiplying the one and two thirds fraction (as between the warp columns to heddle columns) by forty (the number of layers in the multilayer preform). Thus, FIG. 4 shows sixty seven heddles per heddle column as rounded upward to the nearest whole number. The total number of heddles is 201 as determined by multiplying the number of heddles on each heddle column by the total number of heddle columns. The total number of warp fibers is two hundred as determined by multiplying the number of layers in the multilayer preform, or forty layers, by the total number of warp columns, or five warp columns. Thus, FIG. 4 shows that the total number of warp fibers on the warp columns approximately equals the total number of heddles on the heddle columns but for fractional rounding. Note, however, the number of heddles is rounded up to the nearest whole number to ensure a sufficient number of heddles to accommodate the warp fibers.

Figure 5:
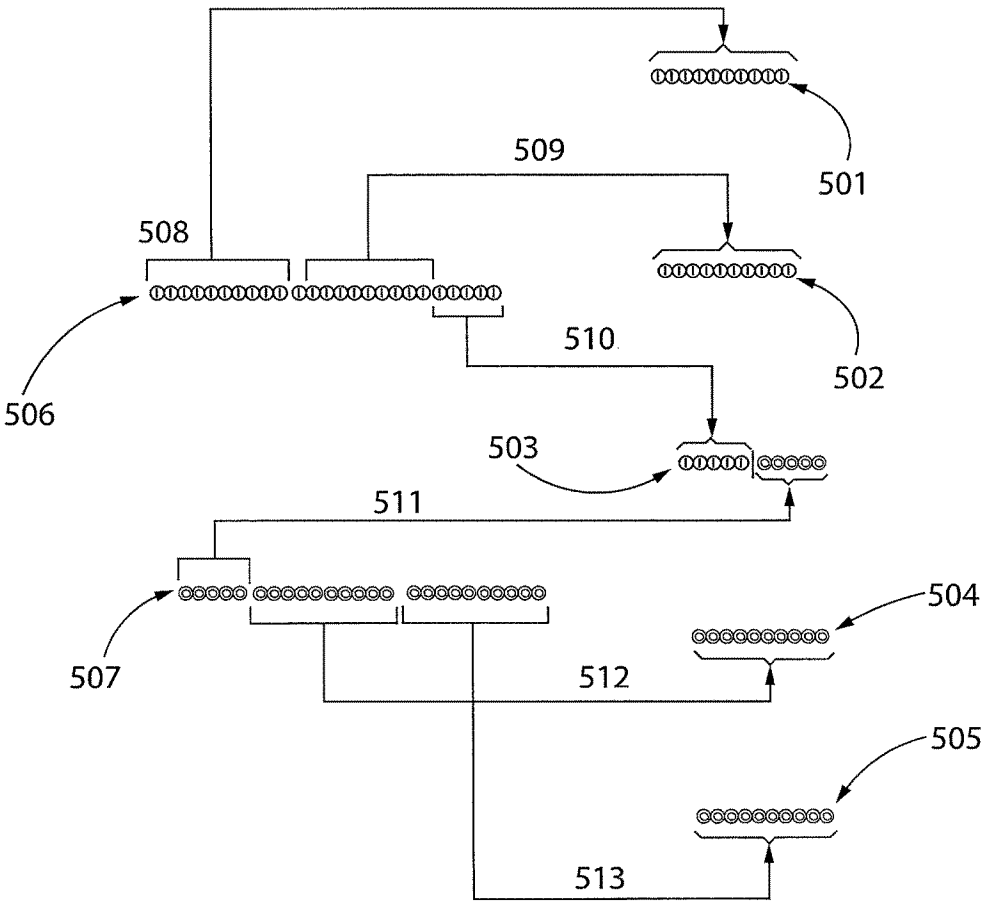
FIG. 5 is a schematic of a top view of five heddle columns and a transverse view of two warp fiber columns with warp fibers.

Turning to FIG. 5, a 25 multilayer preform is woven on a weaving apparatus outfitted with five heddle columns 501-505 and two warp columns 506-507. The ratio of warp columns to heddle columns is two fifths as determined by dividing the number of warp columns by the number of heddle columns. FIG. 5 shows a top view of the five heddle columns 501-505. Each heddle column has ten heddles. FIG. 5 shows a transverse view of the two warp columns 506-507. Each warp column has twenty five warp fibers, equaling the number of layers in the multilayer preform. Each warp fiber is laced through a heddle on one of the heddle columns 501-505.

FIG. 5 shows a method for lacing warp fibers such that the number of warp fibers on the warp columns laced through heddles on a heddle column reflects the fraction as between the number of warp columns to the number of heddle columns. For example, FIG. 5 shows a weaving apparatus where ten—two fifths of twenty five—of all the warp fibers are laced through heddles on a heddle column. For example, ten warp fibers on warp column 506 are laced 508 through heddles on heddle column 501. Ten warp fibers on warp column 506 are laced 509 through heddles on heddle column 502. Five warp fibers on warp column 506 are laced 510 through heddles on heddle column 503. Five warp fibers on warp column 507 are laced 511 through heddles on heddle column 503. Ten warp fibers on warp column 507 are laced 512 through heddles on heddle column 504 and ten warp fibers on warp column 507 are laced 513 through heddles on heddle column 505. Thus, two fifths of the warp fibers on the warp columns are laced through heddles on a heddle column.

The number of heddles on each heddle column in FIG. 5 can be determined by multiplying the two fifths fraction (as between the warp columns to heddle columns) by twenty five (the number of layers in the multilayer preform). Thus, FIG. 5 shows ten heddles per heddle column. The total number of heddles is fifty as determined by multiplying the number of heddles on each heddle column by the total number of heddle columns. The total number of warp fibers is fifty as determined by multiplying the number of layers in the multilayer preform, or twenty five, by the total number of warp columns, or two warp columns. The total number of warp fibers on the warp columns equals the total number of heddles on the heddle columns.

Figure 6:
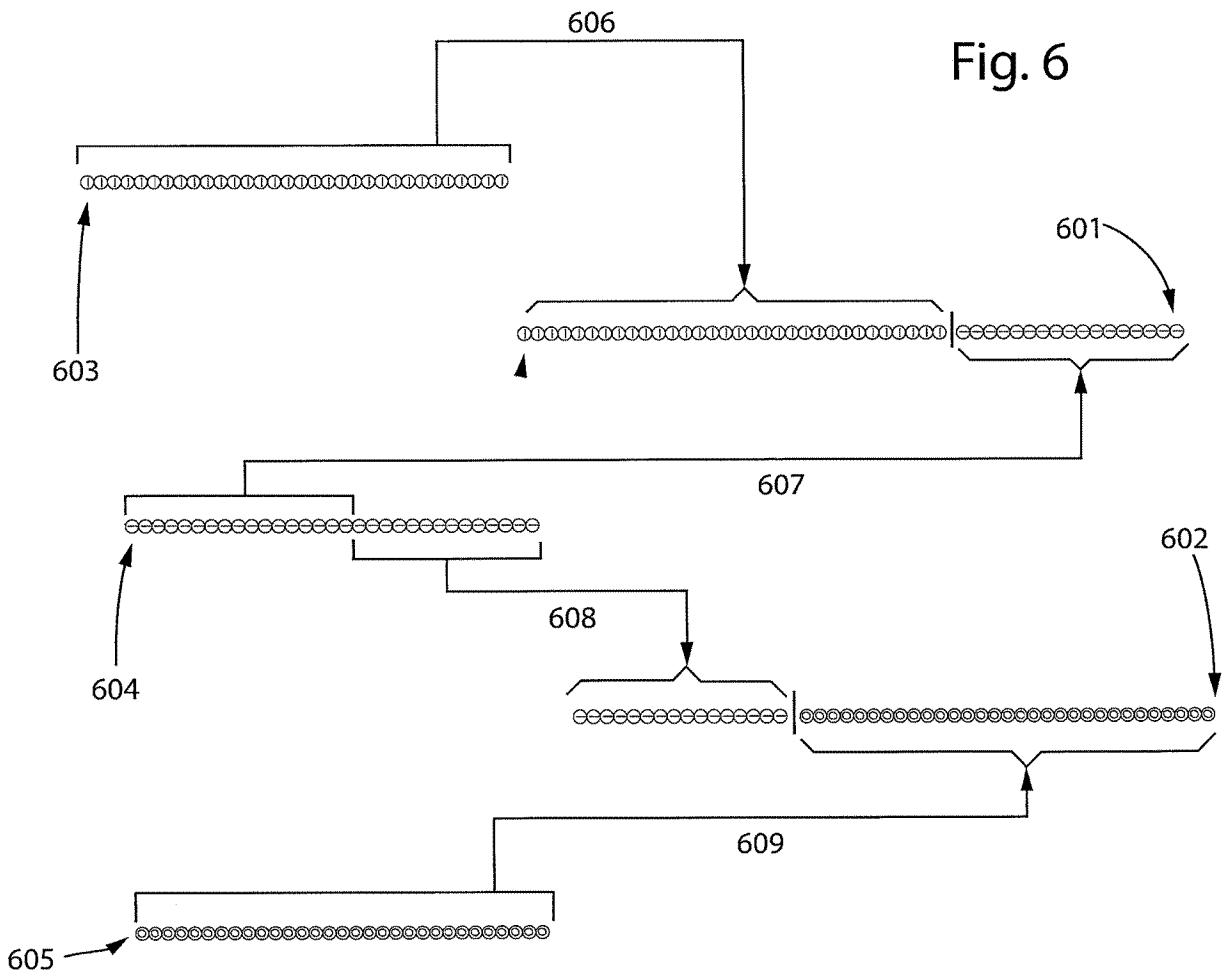
FIG. 6 is a schematic of a top view of two heddle columns and a transverse view of three warp fiber columns with warp fibers.

Turning to FIG. 6, a 32 multilayer preform is woven on a weaving apparatus outfitted with two heddle columns 601, 602 and three warp columns 603-605. The ratio of warp columns to heddle columns is one and a half. FIG. 6 shows a top view of the two heddle columns 601, 602. Each heddle column has forty eight heddles. FIG. 6 shows a transverse view of the three warp columns 603-605. Each warp column has thirty two warp fibers, equaling the number of layers in the multilayer preform. Each warp fiber is laced through a heddle on one of the heddle columns 601-602.

FIG. 6 shows a method for lacing warp fibers such that the number of warp fibers on the warp columns laced through heddles on a heddle column reflects the fraction as between the number of warp columns to the number of heddle columns. For example, FIG. 6 shows a weaving apparatus where all, or thirty two, of the warp fibers on warp column 603 and half, or sixteen, of the warp fibers on warp column 604 are laced 606, 607 through heddles on heddle column 601. FIG. 6 shows the remaining half, or sixteen, of warp fibers on warp column 604 are laced 608 through heddles on heddle column 602 and all, or thirty two, of the warp fibers on warp column 605 are laced 609 through heddles on heddle column 602. Thus, one and a half of the warp fibers on the warp columns are laced through heddles on a heddle column.

The number of heddles on each heddle column in FIG. 6 can be determined by multiplying the one and a half fraction (as between the warp columns to heddle columns) by thirty two (the number of layers in the multilayer preform), equaling forty eight heddles per heddle column. The total number of heddles is ninety six as determined by multiplying the number of heddles on each heddle column, or forty eight, by the total number of heddle columns, or two. The total number of warp fibers is ninety six as determined by multiplying the number of layers in the multilayer preform, or thirty two, by the total number of warp columns, or three. The total number of warp fibers on the warp columns equals the total number of heddles on the heddle columns.

This disclosure can provide lacing 606 all warp fibers on a first warp column 603 through adjacent heddles on a top portion of the first heddle column 601, lacing 607 a top half of the warp fibers on a second warp column 604 through adjacent heddles on the bottom portion of the first heddle column 601, lacing 608 a bottom half of the warp fibers on the second warp column 604 through adjacent heddles on the top portion of a second heddle column 602, and lacing 609 all warp fibers on a third warp column 605 through adjacent heddles on the bottom portion of the second heddle column 602.

This disclosure can provide for an adequate shed space for efficiently weaving weft fibers for a multilayered preform using an apparatus with multiple warp columns and multiple heddle columns having a numerical ratio that is a fractional number. For example, having a high warp column count, as would be understood by a person of skill in the art of at least 3 warp columns, fewer heddle columns, and the numerical ratio between them as a fractional number, eliminates small shed openings and poor warp control that otherwise typically occurs making it difficult to weave a multilayer product.

While embodiments of the invention have been described and variations set forth above, these embodiments and variations are illustrative and the invention is not to be considered limited in scope to these embodiments and variations. For example, the number of layers in the multilayer product can vary. As another non-limiting example, the number of warp columns to heddle columns can vary, e.g. a 1.5 ratio can encompass three warp columns to two heddle columns and twelve warp columns to eight heddle columns, and so on and so forth. Accordingly, various other embodiments and modifications and improvements not described herein may be within the scope of the present disclosure, as defined by the following claims.

The invention claimed is:

1. An apparatus for weaving a multilayer product comprising, one or more warp columns for placement of warp fibers; and one or more heddle columns for placement of heddles for lacing the warp fibers, wherein the numerical ratio of the warp columns and heddle columns is a fractional number that does not reduce to a natural number, and wherein a portion of the warp fibers are laceable through the heddles on one or more of the heddle columns based on the fractional number.

2. The apparatus according to claim 1 and further comprising, a number of heddles on each of the one or more heddle columns that is at least equal to a number of layers in the multilayer product multiplied by the fractional number.

3. The apparatus according to claim 2 and further comprising, a number of warp fibers on each of the one or more warp columns that equals the number of layers in the multilayer product.

4. The apparatus according to claim 3 wherein, the fractional number is between 0.1 and 10.5.

5. The apparatus according to claim 3 wherein, the multilayer product has two or more layers.

6. The apparatus according to claim 1, wherein, the apparatus has two or more warp columns for placement of warp fibers.

7. An apparatus according to claim 6 and further comprising, a number of heddles on each of the one or more heddle columns that is at least equal to a number of layers in the multilayer product multiplied by the fractional number.

8. The apparatus according to claim 7 and further comprising, a number of warp fibers on each of the two or more warp columns that equals the number of layers in the multilayer product.

9. The apparatus according to claim 8 wherein, the fractional number is between 0.1 and 10.

10. The apparatus according to claim 9 wherein, the fractional number is 1.5.

11. The apparatus according to claim 10 wherein, the number of laceable warp fibers is such that one and a half of the total number of warp fibers are laceable through the heddles on a single heddle column.

12. The apparatus according to claim 10 wherein, the number of warp columns is three and the number of heddle columns is two; and wherein the multilayer product is a 32 layer multilayer product, and wherein each of the three warp columns has 32 warp fibers and each of the two heddle columns has 48 heddles.

13. An apparatus for weaving a multilayer product comprising, a numerical ratio of warp columns to heddle columns that is a fractional number that does not reduce to a natural number;

wherein the number of warp columns is a warp column count of at least 3; and wherein the number of heddle columns is less than the warp column count; and wherein a number of warp fibers on each of the warp columns equals the number of layers in the multilayer product;

such that the number of layers in the multiplayer product multiplied by the fractional number and further multiplied by the number of heddle columns is at least equal to the number of layers in the multilayer product multiplied by the warp column count.

14. A method for weaving a multilayer product comprising the steps of, a. having a weaving apparatus with one or more warp columns for placement of warp fibers; and one or more heddle columns for placement of heddles; wherein the numerical ratio of the warp columns to heddle columns is a fractional number that does not reduce to a natural number;

b. segmenting adjacent warp fibers such that the segments are based on the fractional number; and c. lacing the segmented warp fibers through the heddles on the heddle columns based on the fractional number.

15. The method for weaving a multilayer product according to claim 14 wherein, the weaving apparatus has two or more warp columns.

16. The method for weaving a multilayer product according to claim 15 wherein, a. the fractional number is 1.5;

b. lacing all adjacent warp fibers on a first warp column through adjacent heddles on a first heddle column;

c. lacing a first half of adjacent warp fibers on a second warp column through adjacent heddles on the first heddle column, d. lacing a second half of adjacent warp fibers on the second warp column through adjacent heddles on a second heddle column, e. lacing all warp fibers on a third warp column through adjacent heddles on the second heddle column;

f. repeating steps b-e until the warp fibers on the warp columns are laced through heddles on the heddle columns.

17. The method for weaving a multi-layer composite according to claim 16 and further comprising, a. controlling warp fibers on the first warp column with the heddles on the first heddle column, b. controlling the first half of warp fibers on the second warp column with the heddles on the first heddle column, c. controlling the second half of warp fibers on the second warp column with the heddles on the second heddle column, d. controlling the warp fibers on the third warp column with the heddles on the second heddle column, and e. repeating steps a-d until the warp fibers on the warp columns are controlled with heddles on the heddle columns.

18. The method for weaving a multilayer product according to claim 16 wherein, a. all warp fibers on the first warp column are laced through adjacent heddles on a top portion of the first heddle column, b. a top half of the warp fibers on the second warp column are laced through adjacent heddles on a bottom portion of the first heddle column, c. a bottom half of the warp fibers on the second warp column are laced through adjacent heddles on a top portion of the second heddle column, and d. all warp fibers on the third warp column are laced through adjacent heddles on a bottom portion of the second heddle column;

e. repeating steps a-d until the warp fibers on the warp columns are laced through heddles on the heddle columns.

19. The method according to claim 18 wherein, a. the weaving apparatus has three warp columns and two heddle columns;

b. 32 adjacent warp fibers are laced through 32 adjacent heddles on the top portion of the first heddle column, c. 16 adjacent warp fibers on the top half of the second warp column are laced through 16 adjacent heddles on the bottom portion of the first heddle column, d. 16 adjacent warp fibers on the bottom half of the second warp column are laced through 16 adjacent heddles on the top portion of the second heddle column, and e. 32 adjacent warp fibers on the third warp column are laced through 32 adjacent heddles on the bottom portion of the second heddle column.

20. The method for weaving a multilayer product according to claim 14 wherein, a. wherein the number of warp columns is a warp column count of at least 3;

b. and wherein the number of heddle columns is lower than the warp column count.

* * * * *